US007986106B2

(12) United States Patent
Chen et al.

(10) Patent No.: US 7,986,106 B2
(45) Date of Patent: Jul. 26, 2011

(54) PROTECTION CIRCUIT AND DISCHARGE LAMP DRIVING DEVICE EMPLOYING THE SAME

(75) Inventors: Hung-Yi Chen, Hsinchu (TW); Chi-Hsiung Lee, Hsinchu (TW); Yu-Hsiao Chao, Hsinchu (TW)

(73) Assignee: Ampower Technology Co., Ltd., Jhongli, Taoyuan County (TW)

( * ) Notice: Subject to any disclaimer, the term of this patent is extended or adjusted under 35 U.S.C. 154(b) by 428 days.

(21) Appl. No.: 12/277,228

(22) Filed: Nov. 24, 2008

(65) Prior Publication Data

US 2010/0019694 A1 Jan. 28, 2010

(30) Foreign Application Priority Data

Jul. 25, 2008 (CN) ..... 2008 1 0142611

(51) Int. Cl.
*H05B 41/36* (2006.01)

(52) U.S. Cl. ..... 315/291; 315/209 R; 315/224; 315/307; 315/308; 315/312; 345/102

(58) Field of Classification Search ..... 315/224, 315/210, 209 R, 291, 299, 307, 308, 312, 315/324, DIG. 2, DIG. 5
See application file for complete search history.

(56) References Cited

U.S. PATENT DOCUMENTS 6,922,023 B2 * 7/2005 Hsu et al. ..... 315/291
2005/0225261 A1 * 10/2005 Jin ..... 315/255

* cited by examiner

*Primary Examiner* — Douglas W Owens
*Assistant Examiner* — Thai Pham
(74) *Attorney, Agent, or Firm* — Frank R. Niranjan

(57) ABSTRACT

A discharge lamp driving device includes a power stage circuit, a transformer circuit, a control circuit, a feedback circuit and a lamp protection circuit. The lamp protection circuit includes a current sensing circuit, a reference voltage selecting circuit, a comparing circuit and a protection signal generating circuit. The current sensing circuit senses current signals flowing through the lamps, and transforms the current signals to voltage signals. The reference voltage selecting circuit is connected to the current sensing circuit. The comparing circuit is connected to the current sensing circuit and the comparing circuit. The protection signal generating circuit is connected between the comparing circuit and the control circuit. The control circuit is connected to the comparing circuit.

12 Claims, 3 Drawing Sheets

PROTECTION CIRCUIT AND DISCHARGE LAMP DRIVING DEVICE EMPLOYING THE SAME

BACKGROUND

1. Technical Field

The disclosure relates to discharge lamp driving devices, and particularly to a protection circuit of a discharge lamp driving device.

2. Description of Related Art

With the development of lighting technology, in many lighting devices, such as liquid crystal display (LCD) devices, at least two groups of discharge lamps are commonly employed for achieving a better lighting effect to meet practical lighting requirements. Typically, in order to protect the lighting device from being damaged under the circumstance that one or more of the at least two groups of discharge lamps are short or open, an open protection circuit and a short protection circuit are configured in the lighting circuit. The open and short protection circuits provide protection signals to control current input to the discharge lamps, thereby protect the lighting device from being damaged or destroyed by very high voltage.

Referring to FIG. 3, a schematic diagram of a conventional discharge lamp driving device 10 is shown. The discharge lamp driving device 10 includes a power stage circuit 100, a control circuit 101, a feedback circuit 102, a lamp protection circuit 103, and a transformer circuit 104. The lamp protection circuit 103 includes a current sensing circuit 1031, an open protection circuit 1032, and a short protection circuit 1033. When a first lamp L1 or a second lamp L2 is open, current signals flowing through the first lamp L1 and the second lamp L2 are sensed respectively by a first current sensing unit 1031A and a second current sensing unit 1031B, and are transmitted to the open protection circuit 1032. Subsequently, the open protection circuit 1032 transforms the current signals to an open circuit protection signal, and transmits the open circuit protection signal to a control circuit 101. The control circuit 101 transforms the open circuit protection signal to a control signal to control the output of the power stage circuit 100 to the first lamp L1 and the second lamp L2. Thereby, the lamps L1 and L2 are protected.

Similarly, when the first lamp L1 or the second lamp L2 is shorted, the current signals flowing through the first lamp L1 and the second lamp L2 are sensed respectively by the first current sensing unit 1031A and the second current sensing unit 1031B, and are transmitted to the short protection circuit 1033. Subsequently, the short protection circuit 1033 transforms the current signals to a short circuit protection signal, and transmits the short circuit protection signal to the control circuit 101. The control circuit 101 transforms the short circuit protection signal to a control signal to control the output of the power stage circuit 100 to the first lamp L1 and the second lamp L2. Thereby, the lamps L1 and L2 are protected.

In the discharge lamp driving device 10, the open protection circuit 1032 and the short protection circuit 1033 are independent of each other. Accordingly, two sets of voltage dividing resistors and crystal field-effect transistors (FETs) are generally needed. In addition, the open protection circuit 1032 or the short protection circuit 1033 may wrongly output a protection signal when either of the lamps L1 and L2 is operating normally albeit at a higher voltage than usual. That is, the protection function of the discharge lamp driving device 10 may be unreliable.

DETAILED DESCRIPTION OF EMBODIMENTS

Figure 1:
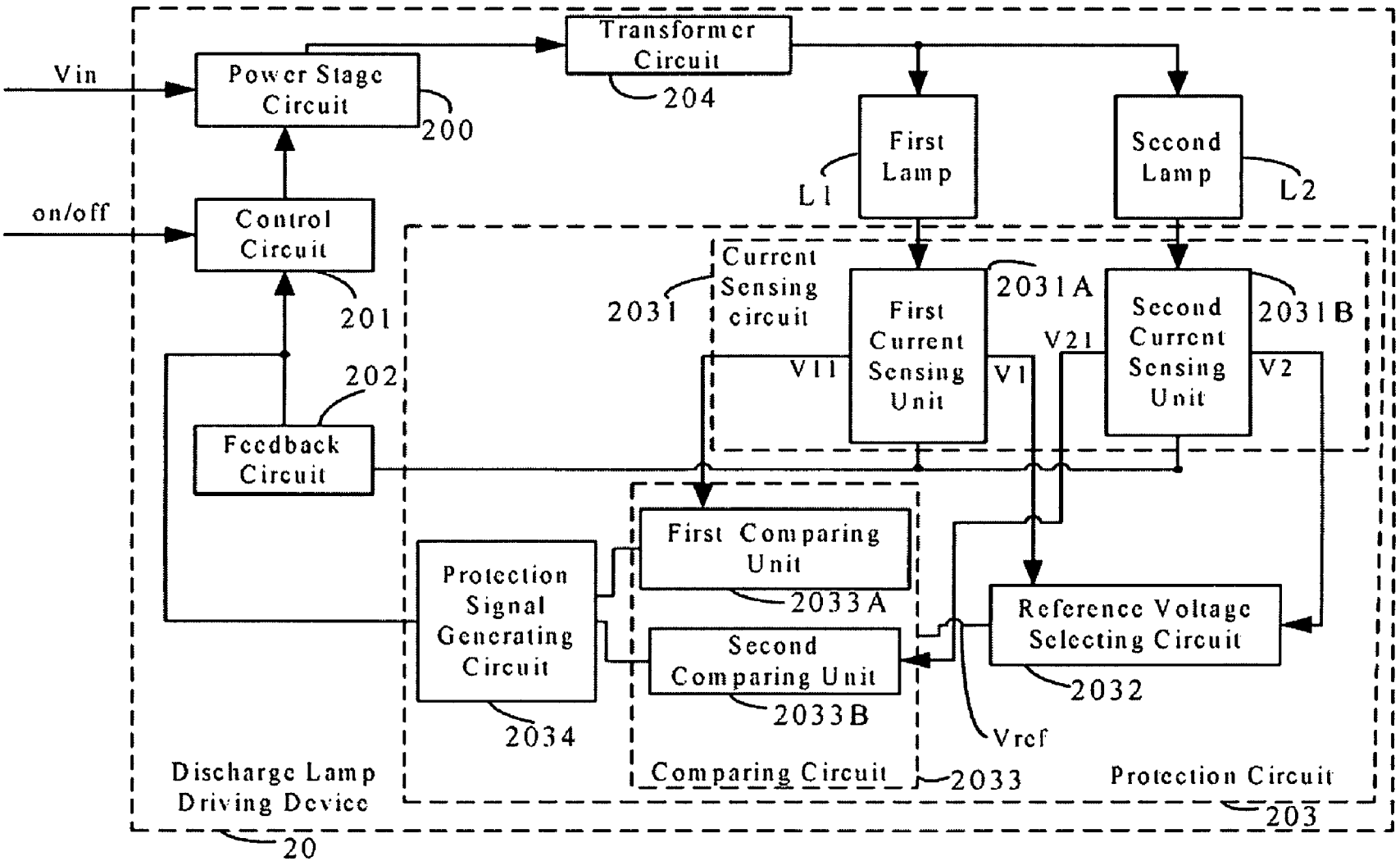
FIG. 1 is a schematic diagram of a discharge lamp driving device in accordance with an exemplary embodiment of the disclosure, the discharge lamp driving device comprising a protection circuit and a control circuit.

Referring to FIG. 1, a discharge lamp driving device 20 in accordance with an exemplary embodiment of the disclosure comprises a power stage circuit 200, a control circuit 201, a feedback circuit 202, a protection circuit 203, and a transformer circuit 204 for driving lamps that are disposed between the transformer circuit 204 and the protection circuit 203. In this exemplary embodiment, only two lamps L1, L2 are shown for simplification and convenience of description. The power stage circuit 200 transforms a received external signal to an alternating current (AC) signal. The transformer circuit 204 is connected to the power stage circuit 200, and transforms the AC signal to one or more electrical signals able to drive the lamps L1, L2. In this embodiment, the one or more electrical signals are sine wave signals.

In the exemplary embodiment, the protection circuit 203 includes a current sensing circuit 2031, a reference voltage selecting circuit 2032, a comparing circuit 2033, and a protection signal generating circuit 2034. Typically, the current sensing circuit 2031 comprises a plurality of current sensing units, which are respectively connected to a plurality of lamps and which sense current flowing through the lamps. In this exemplary embodiment, the current sensing circuit 2031 includes a first current sensing unit 2031A and a second current sensing unit 2031B, for respectively sensing current flowing through the first lamp L1 and the second lamp L2, and transforming the sensed currents to first and second voltage signals V1, V2. Furthermore, the first current sensing unit 2031A divides the first voltage signal V1 to produce a first divided voltage signal V11, and the second current sensing unit 2031B divides the second voltage signal V2 to produce a second divided voltage signal V21. In other exemplary embodiments, there may be more than two lamps, and correspondingly more than two current sensing units.

The reference voltage selecting circuit 2032 is connected to the current sensing circuit 2031. The reference voltage selecting circuit 2032 compares the first voltage signal V1 with the second voltage signal V2, and generates a reference voltage signal Vref based on the larger one of the two voltage signals V1, V2.

The comparing circuit 2033 is connected to the current sensing circuit 2031 and the reference voltage selecting circuit 2032, and comprises a plurality of comparing units that are respectively connected to the current sensing units of the current sensing circuit 2031. In this embodiment, the comparing circuit 2033 comprises a first comparing unit 2033A and a second comparing unit 2033B. The first comparing unit 2033A is connected to the first current sensing unit 2031A and the reference voltage selecting circuit 2032, for receiving and comparing the first divided voltage signal V11 and the reference voltage signal Vref to generate a first comparing signal. The second comparing unit 2033B is connected to the second current sensing unit 2031B and the reference voltage selecting circuit 2032, for receiving and comparing the second divided voltage signal V21 and the reference voltage signal Vref to generate a second comparing signal. In other exemplary embodiments, if the number of lamps is increased, the number of comparing units is correspondingly increased as well.

The protection signal generating circuit 2034 is connected to the comparing circuit 2033. The protection signal generating circuit 2034 selects the largest one of the comparing signals from the plurality of comparing units, and subsequently outputs the largest comparing signal as the protection signal.

The control circuit 201 is connected between the power stage circuit 200 and the protection signal generating circuit 2034 that is configured in the protection circuit 203. The control circuit 201 transforms the protection signal to a control signal, which is transmitted to the power stage circuit 200 to control the output of the power stage circuit 200 to the lamp L1 and the lamp L2.

The feedback circuit 202 is connected between the control circuit 201 and the current sensing circuit 2031, to feed back the amount of current flowing through the first lamp L1 and the second lamp L2 to the control circuit 201. At the same time, the control circuit 201 also controls the output of the power stage circuit 200 according to the feedback.

Figure 2:
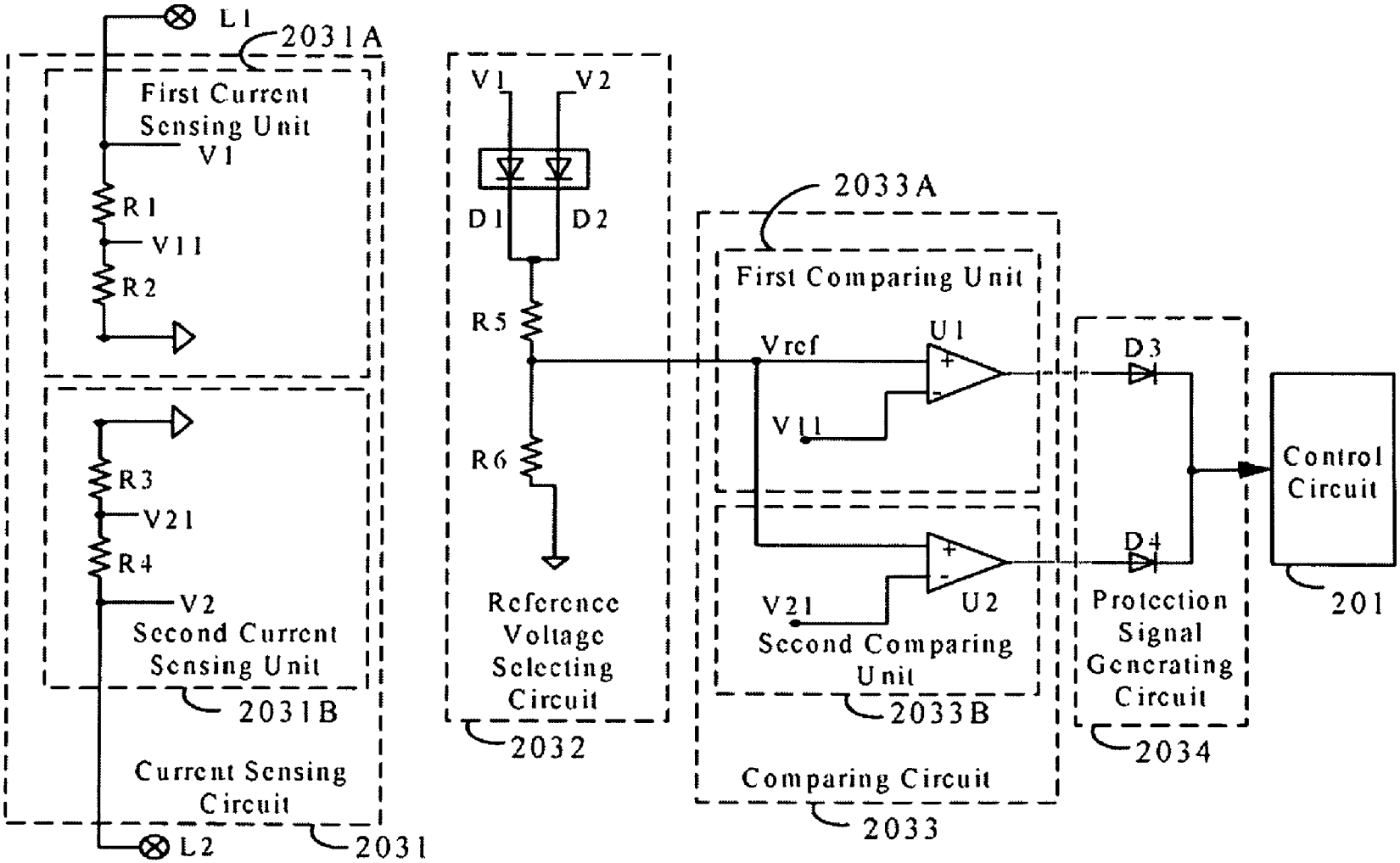
FIG. 2 is a schematic diagram of the protection circuit and control circuit of FIG. 1, showing details of the protection circuit.
Figure 3:
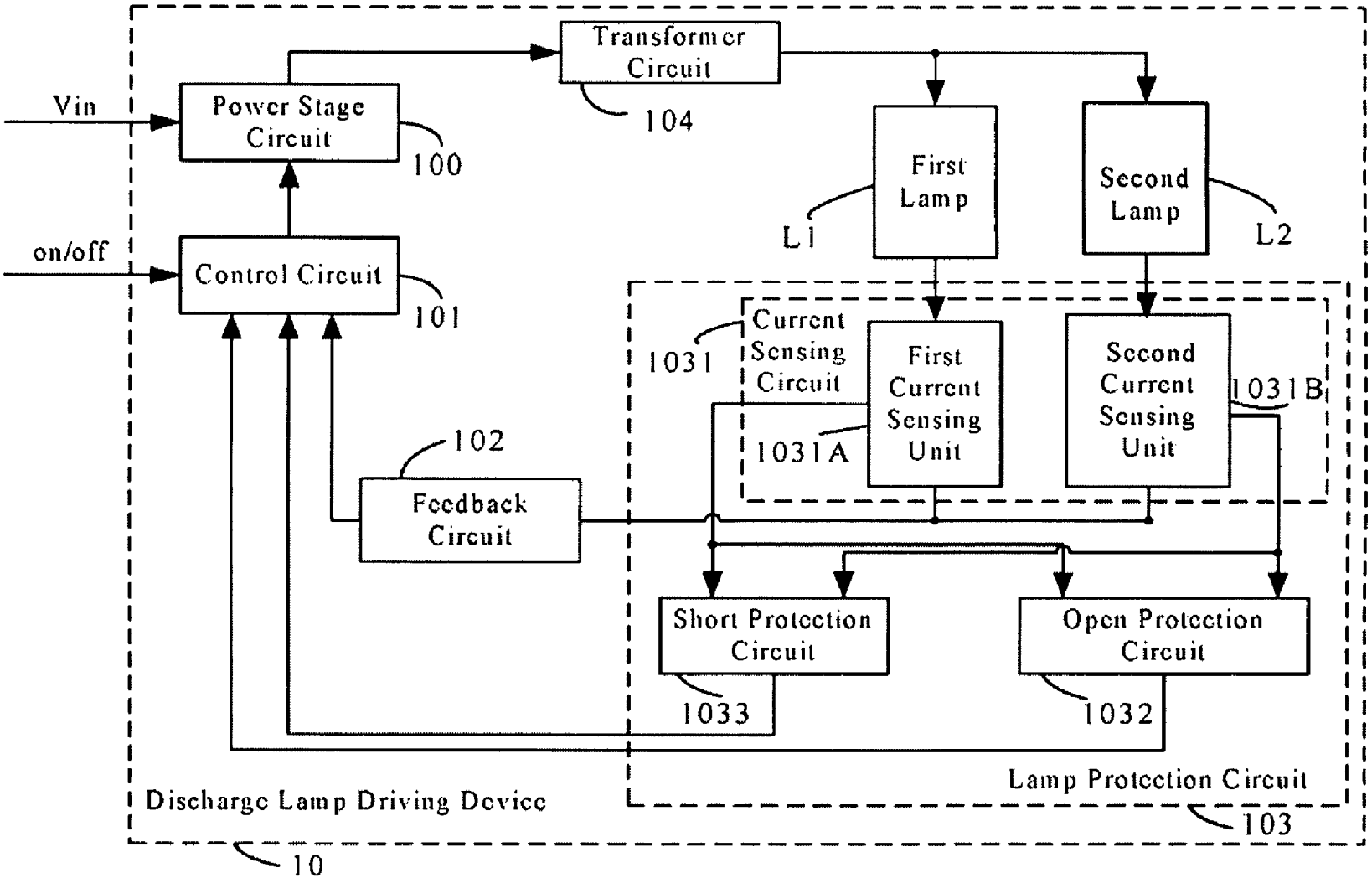
FIG. 3 (PRIOR ART)
FIG. 3 is a schematic diagram of a conventional discharge lamp driving device.

FIG. 2 is essentially a detailed diagram of the protection circuit 203 in accordance with the exemplary embodiment of the disclosure. In this exemplary embodiment, the first current sensing unit 2031A includes a first division voltage circuit. The first division voltage circuit comprises a first resistor R1 and a second resistor R2, and divides the first voltage signal V1 to produce the first divided voltage signal V11. The first resistor R1 and the second resistor R2 are connected in series between the first lamp L1 and ground. The first voltage signal V1 is output from a common node of the first lamp L1 and the first resistor R1, and the first divided voltage signal V11 is output from a common node of the first resistor R1 and the second resistor R2.

The second current sensing unit 2031B comprises a second division voltage circuit. The second division voltage circuit comprises a third resistor R3 and a fourth resistor R4, and divides the second voltage signal V2 to produce a second divided voltage signal V21. The third resistor R3 and the fourth resistor R4 are connected in series between the second lamp L2 and ground. The second voltage signal V2 is output from a common node of the second lamp L2 and the fourth resistor R4, and the second divided voltage signal V21 is output from a common node of the third resistor R3 and the fourth resistor R4. In this exemplary embodiment, the resistances of the first resistor R1 and the fourth resistor R4 are equal, and the resistances of the second resistor R2 and the third resistor R3 are equal.

The reference voltage selecting circuit 2032 comprises a first diode D1, a second diode D2, and a third division voltage circuit which includes a fifth resistor R5 and a sixth resistor R6. The anode of the first diode D1 is electrically connected to the first current sensing unit 2031A, and the anode of the second diode D2 is electrically connected to the second current sensing unit 2031B. Specifically, the anode of the first diode D1 is connected to the common node of the first resistor R1 and the first lamp L1 to receive the first voltage signal V1, and the anode of the second diode D2 is connected to the common node of the fourth resistor R4 and the second lamp L2 to receive the second voltage signal V2. The cathodes of the first diode D1 and the second diode D2 are connected together. The fifth resistor R5 and the sixth resistor R6 are connected in series between ground and a common node of the cathodes of the first diode D1 and the second diode D2, and divide the larger one of the voltage signals V1, V2 which are output from the first diode D1 and the second diode D2 as the reference voltage Vref. In this exemplary embodiment, the resistance of the fifth resistor R5 is greater than that of the sixth resistor R6 but smaller than the resistance of any of the resistors R1, R2, R3 and R4. In other embodiments, the number and the resistances of the resistors may be determined and configured according to practical requirements of actual circuits, and are not limited by the disclosure of this embodiment.

The comparing circuit 2033 is connected to the current sensing circuit 2031 and the reference voltage selecting circuit 2032, and includes the first comparing unit 2033A and the second comparing unit 2033B. The first comparing unit 2033A includes a first comparator U1. A first input end of the first comparator U1 is connected to the reference voltage selecting circuit 2032 for receiving the reference voltage signal Vref, a second input end of the first comparator U1 is connected to the first current sensing unit 2031A for receiving the first divided voltage signal V11, and an output end of the first comparator U1 outputs the first comparing signal. The second comparing unit 2033B includes a second comparator U2. A first input end of the second comparator U2 is connected to the reference voltage selecting circuit 2032 for receiving the reference voltage signal Vref, a second input end of the second comparator U2 is connected to the second current sensing unit 2031B for receiving the second divided voltage signal V21, and an output end of the second comparator U2 outputs the second comparing signal. In this exemplary embodiment, the first input ends of the comparators U1, U2 are positive, and the second input ends thereof are negative. In other embodiments, the first input ends of the comparators U1, U2 may be negative, and the second input ends thereof may be positive.

The protection signal generating circuit 2034 is connected to the comparing circuit 2033, and includes a third diode D3 and a fourth diode D4. The protection signal generating circuit 2034 generates the protection signal based on a larger one of the first comparing signal and the second comparing signal, and outputs the protection signal to the control circuit 201. Specifically, the anode of the third diode D3 is connected to the output end of the first comparator U1 for receiving the first comparing signal. The anode of the fourth diode D4 is connected to the output end of the second comparator U2 for receiving the second comparing signal. The cathodes of the third diode D3 and the fourth diode D4 are connected together, for generating the protection signal based on the larger one of the first comparing signal and the second comparing signal and outputting the protection signal to the control circuit 201.

In the present embodiment, it is assumed that the control circuit 201 generates a control signal to shut off the power stage circuit 200 when the protection signal is a high voltage signal. In this exemplary embodiment, it is assumed that the resistances of the first resistor R1 and the fourth resistor R4 are both 806 kiloohms (kΩ), the resistances of the second resistor R2 and the third resistor R3 are both 1200 kΩ, the resistance of the fifth resistor R5 is 73.2 kΩ, and the resistance of the sixth resistor R6 is 30.1 kΩ.

When the first lamp L1 and the second lamp L2 both operate normally, the difference between the currents respectively flowing through the two lamps L1, L2 is in accordance with a predetermined value. In the present embodiment, it is assumed that the values of currents respectively flowing through the two lamps L1, L2 are substantially equal. Correspondingly, the values of the first voltage signal V1 and the second voltage V2 are substantially equal too, both being substantially 12 volts (V). Accordingly, the values of the first divided voltage signal V11 and the second divided voltage V21 are equal, both being 4.82V; and the value of the reference voltage Vref is about 3.49V at this state. According to the foregoing descriptions, the value of the voltage of the positive input ends of the first comparator U1 and the second comparator U2 of the comparing circuit 2033 is 3.49V, and the value of the voltage of the negative input ends of the first comparator U1 and the second comparator U2 is 4.82V. That is, the voltage levels of the positive input ends of the first comparator U1 and the second comparator U2 are lower than those of the negative input ends thereof. Accordingly, the output ends of the first comparator U1 and the second comparator U2 both output low voltage signals. As a result, the third diode D3 and the fourth diode D4 do not output a high voltage signal. Thereby, the control circuit 201 does not generate a control signal to shut off the power stage circuit 200, and the discharge lamp driving device 20 operates normally.

When one of the lamps L1, L2 is open or shorted, the difference between the currents flowing through the lamps L1, L2 is not in accordance with the predetermined value. That is, the currents flowing through the lamps L1, L2 are unbalanced. Accordingly, the protection circuit 203 protects the lamps L1, L2. In this exemplary embodiment, when the value of the current difference between the currents flowing through the first lamp L1 and the second lamp L2 is 2 milliamperes (mA), and the value of the voltage difference between the first voltage V1 and the second voltage V2 correspondingly is 4V, the protection circuit 203 shuts off the power stage circuit 200 to protect the lamps L1, L2. For instance, if the first lamp L1 is shorted and the second lamp L2 operates normally, the current flowing through the first lamp L1 is larger than that flowing through the second lamp L2. In this exemplary embodiment, according to the foregoing descriptions, if the value of the first voltage signal V1 is 18V, the value of the second voltage signal V2 is 6V.

In this state, the reference voltage selecting circuit 201 selects the first voltage signal V1 as the reference voltage Vref, and outputs the first voltage signal V1 to the positive input ends of the first comparator U1 and the second comparator U2. In this exemplary embodiment, the first voltage signal V1 is transmitted through the first diode D1 to the third division voltage circuit comprised of the fifth resistor R5 and the sixth resistor R6. The first voltage signal V1 is divided so as to generate the reference voltage Vref, which subsequently is output to the comparing circuit 2033. The value of the reference voltage signal Vref is 5.24V in this situation.

In the comparing circuit 2033, the reference voltage signal Vref is output to the positive input ends of the first comparator U1 and the second comparator U2, and the first divided voltage signal V11 is transmitted to the negative input end of the first comparator U1 through the first current sensing unit 2031A. Similarly, the second divided voltage signal V21 is transmitted to the negative input end of the second comparator U2 through the second current sensing unit 2031B. In this state, the value of the first divided voltage V11 is 7.25V and the value of the second divided voltage V21 is 2.41V.

In the first comparing unit 2033A, the first comparator U1 compares the reference voltage signal Vref with the first divided voltage signal V11 and generates the first comparing signal. According to the foregoing descriptions, the voltage signal of the positive input end of the first comparator U1 is smaller than that of the negative input end thereof. Accordingly, the first comparing signal output from the first comparator U1 is a low voltage signal. Similarly, in the second comparing unit 2033B, the second comparator U2 compares the reference voltage signal Vref with the second divided voltage signal V21 and generates the second comparing signal. The voltage signal of the positive input end of the second comparator U2 is larger than that of the negative input end thereof. Accordingly, the second comparing signal output from the second comparator U2 is a high voltage signal.

In the protection signal generating circuit 2034, the first comparing signal is the low voltage signal, while the second comparing signal is the high voltage signal. According to the foregoing descriptions, the high voltage signal is used as the protection signal to output to the control circuit 201 through the cathode of the fourth diode D4. As a result, the control circuit 201 transforms the protection signal to a control signal to shut off the power stage circuit 200.

When the first lamp L1 is open, and the second lamp L2 is short or operates normally, the current signal flowing through the first lamp L1 is smaller than that of the second lamp L2, and the first voltage signal V1 is smaller than that of the second voltage signal V2. Accordingly, the reference voltage selecting circuit 2032 selects the second voltage signal V2 as the reference voltage Vref, and outputs the second voltage signal V2 to the positive input ends of the first comparator U1 and the second comparator U2. The first current sensing unit 2031A outputs the first divided voltage signal V11 to the negative input end of the first comparator U1, and the second current sensing unit 2031B outputs the second divided voltage signal V21 to the negative input end of the second comparator U2. In this state, the first comparing signal output from the first comparator U1 is a high voltage signal, and the second comparing signal output from the second comparator U2 is a low voltage signal.

In the protection signal generating circuit 2034, the third diode D3 receives the high voltage signal output from the first comparator U1, and the fourth diode D4 receives the low voltage signal output from the second comparator U2. According to the foregoing descriptions, only the high voltage signal is used as the protection signal through the negative end of the third diode D3. As a result, the control circuit 201 transforms the protection signal to a control signal to shut off the power stage circuit 200.

In various exemplary operational embodiments, either or both of the first lamp L1 and the second lamp L2 may be short, open, or operating normally. The changed operating status of the lamps L1, L2 involved in the range of the disclosure can be dealt with and the discharge lamp driving device 20 and protection circuit 203 implemented according to the circuit principles disclosed above. Accordingly, detailed descriptions of operation of the discharge lamp driving device 20 and protection circuit 203 under certain exemplary operational embodiments are omitted.

In summary, the embodiments disclose a protection circuit configured in a discharge lamp driving device. The protection circuit has the capability of: sensing current variation between different lamps when a short or open circuit or another kind of operation abnormality occurs in one or more of the lamps; transforming the current variation to voltage signals; and generating a control signal by comparing the voltage signals to control the operational output of the discharge lamp driving device. As a result, the lamps and other related parts are protected.

It is believed that the exemplary embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A discharge lamp driving device for driving a plurality of lamps, the discharge lamp driving device comprising:

a power stage circuit configured for transforming a received external signal to an alternating current (AC) signal;

a transformer circuit connected to the power stage circuit and configured for transforming the AC signal to a plurality of electrical signals for driving the plurality of lamps;

a protection circuit, comprising:

a current sensing circuit connected to the lamps, and configured for sensing current signals flowing through the lamps, transforming the current signals to a plurality of voltage signals, and dividing the voltage signals into a plurality of divided voltage signals;

a reference voltage selecting circuit connected to the current sensing circuit, and configured for comparing the plurality of voltage signals and generating a reference voltage signal based on a largest one of the voltage signals;

a comparing circuit connected to the reference voltage selecting circuit and the current sensing circuit, and configured for comparing the reference voltage signal with the plurality of divided voltage signals and generating a plurality of comparing signals; and a protection signal generating circuit connected to the comparing circuit, and configured for generating a protection signal based on a largest one of the comparing signals; and a control circuit connected between the protection signal generating circuit and the power stage circuit, and configured for transforming the protection signal to a control signal to control the output of the AC signal by the power stage circuit.

2. The discharge lamp driving device of claim 1, wherein the current sensing circuit comprises a plurality of current sensing units, each of which is connected to a respective one of the lamps and configured for sensing the current signal flowing therethrough and transforming the current signal to a respective one of the voltage signals.

3. The discharge lamp driving device of claim 2, wherein each current sensing unit comprises a plurality of resistors connected in series between the respective one of the lamps and ground for dividing the voltage signal into the divided voltage signal.

4. The discharge lamp driving device of claim 3, wherein the reference voltage selecting circuit comprises:

a plurality of diodes, the anode of each of the diodes being connected to a respective one of the current sensing units for receiving the voltage signal, and the cathodes of the diodes being connected together and having a common node; and a plurality of resistors connected in series between the common node and ground, the common node capable of outputting the reference voltage signal.

5. The discharge lamp driving device of claim 4, wherein the plurality of resistors is capable of dividing the largest one of the voltage signals to generate the reference voltage signal.

6. The discharge lamp driving device of claim 4, wherein the comparing circuit comprises a plurality of comparing units, each of which comprises a comparator configured for generating a comparing signal according to a result of comparing the reference voltage signal and a respective one of the divided voltage signals, wherein a first input end of the comparator is electrically connected to the reference voltage selecting circuit, and a second input end of the comparator is connected to a respective one of the current sensing units.

7. The discharge lamp driving device of claim 6, wherein the protection signal generating circuit comprises a plurality of diodes, the anode of each of the diodes is connected to the output end of a respective one of the comparators for receiving the comparing signal therefrom, and the cathodes of the diodes are connected together for generating the protection signal based on the largest one of the comparing signals.

8. A protection circuit for generating a protection signal when at least one of a plurality of lamps operates abnormally, the protection circuit comprising:

a plurality of current sensing units configured for sensing current signals flowing through the plurality of lamps, transforming the current signals to a plurality of voltage signals, and dividing the voltage signals into a plurality of divided voltage signals;

a reference voltage selecting circuit connected to the plurality of current sensing units, and configured for comparing the plurality of voltage signals and generating a reference voltage signal based on a largest one of the voltage signals;

a plurality of comparing units connected to the reference voltage selecting circuit and the plurality of current sensing units, and configured for comparing the reference voltage signal with the plurality of divided voltage signals and generating a plurality of comparing signals; and a protection signal generating circuit connected to the plurality of comparing units, and configured for generating a protection signal based on a largest one of the comparing signals.

9. The protection circuit of claim 8, wherein each current sensing unit comprises a plurality of resistors connected in series between the respective one of the lamps and ground for dividing a respective one of the voltage signals into a respective one of the divided voltage signals.

10. The protection circuit of claim 9, wherein the reference voltage selecting circuit comprises:

a plurality of diodes, the anode of each of the diodes being connected to a respective one of the current sensing units for receiving the voltage signal, and the cathodes of the diodes being connected together and having a common node; and a plurality of resistors connected in series between the common node and ground, the common node capable of outputting the reference voltage signal.

11. The protection circuit of claim 10, wherein each comparing unit comprises a comparator configured for generating a comparing signal according to a result of comparing the reference voltage signal and a respective one of the divided voltage signals, wherein a first input end of the comparator is electrically connected to the reference voltage selecting circuit, and a second input end of the comparator is connected to a respective one of the current sensing units.

12. The protection circuit of claim 11, wherein the protection signal generating circuit comprises a plurality of diodes, the anode of each of the diodes is connected to the output end of a respective one of the comparators for receiving the comparing signal therefrom, and the cathodes of the diodes are connected together for generating the protection signal based on the largest one of the comparing signals.

* * * * *